US012402693B2

(12) United States Patent
Koene

(10) Patent No.: US 12,402,693 B2
(45) Date of Patent: Sep. 2, 2025

(54) HEEL CAP ASSEMBLY

(71) Applicant: Adjovi Koene, Los Angeles, CA (US)

(72) Inventor: Adjovi Koene, Los Angeles, CA (US)

( * ) Notice: Subject to any disclaimer, the term of this patent is extended or adjusted under 35 U.S.C. 154(b) by 0 days.

(21) Appl. No.: 18/120,384

(22) Filed: Mar. 11, 2023

(65) Prior Publication Data

US 2024/0298749 A1 Sep. 12, 2024

(51) Int. Cl.
*A43B 21/42* (2006.01)

(52) U.S. Cl.
CPC ..... *A43B 21/42* (2013.01)

(58) Field of Classification Search
None
See application file for complete search history.

(56) References Cited

U.S. PATENT DOCUMENTS 636,796 A 11/1899 Haigh
1,261,525 A 4/1918 Helwitz
1,585,856 A 5/1926 Headley
1,875,806 A 9/1932 Givens
2,272,248 A 2/1942 Pearson
2,478,264 A 8/1949 George et al.
2,829,447 A * 4/1958 Odom ..... A43B 21/433 36/42
2,851,797 A 9/1958 Ronci
2,875,534 A 3/1959 Grossman
2,935,799 A 5/1960 Ronci
2,935,800 A 5/1960 Ronci
2,937,461 A 5/1960 Trela
2,940,186 A 6/1960 Boldt
3,034,234 A * 5/1962 Portelli ..... A43B 21/433 36/36 R
3,035,358 A * 5/1962 Ross ..... A43B 21/42 36/34 R
3,048,932 A 8/1962 Ronci
3,050,877 A 8/1962 Ronci
3,055,125 A 9/1962 Ronci
3,074,187 A 1/1963 Klein
3,119,192 A 1/1964 Ronci
3,130,503 A 4/1964 Rosan
3,134,180 A 5/1964 Stone
3,138,882 A 6/1964 Maya
3,141,248 A 7/1964 Harris
3,141,249 A 7/1964 Perisse
3,150,453 A 9/1964 Tilden
3,152,408 A 10/1964 Thiessen
3,159,928 A 12/1964 Clark
3,174,235 A * 3/1965 Johnston ..... A43B 21/26 36/36 R (Continued)

*Primary Examiner* — Jila M Mohandesi
(74) *Attorney, Agent, or Firm* — Sue C. Watson

(57) ABSTRACT

A heel cap assembly for use with a high heeled shoe includes a rod, an insert, and a heel cap. At least a portion of the insert is configured to connect to a lower end of the rod. The insert includes an outer perimeter having a plurality of protrusions thereon. The insert is held within a portion of the heel cap, and at least a portion of the heel cap is formed from a resilient material. The heel cap is frictionally moveable within the insert into a selected position, and after a user's weight is applied to the shoe, the heel cap is non-movably fixed in the selected position. An upper end of the rod is configured to be positioned into a heel post of a shoe, to connect the heel cap assembly to the shoe.

17 Claims, 12 Drawing Sheets

(56) References Cited

U.S. PATENT DOCUMENTS

| | | | | |
|---|---|---|---|---|
| 3,182,409 | A | 5/1965 | Herremans | |
| 3,184,865 | A | 5/1965 | Ronci | |
| 3,226,850 | A | 1/1966 | Ronci | |
| 3,243,900 | A | 4/1966 | Ronci | |
| 3,251,146 | A | 5/1966 | Slosberg | |
| 3,261,115 | A | 7/1966 | Manze | |
| 3,262,221 | A | 7/1966 | Antelo | |
| 3,439,435 | A | 4/1969 | Fredon | |
| 3,473,241 | A | 10/1969 | Parma | |
| 4,819,344 | A | 4/1989 | Schuller | |
| 4,907,351 | A | 3/1990 | Hirai | |
| 5,311,675 | A | 5/1994 | Topel | |
| 6,442,871 | B2 | 9/2002 | Doerer et al. | |
| 9,301,575 | B2 | 4/2016 | Hwang et al. | |
| D794,921 | S | 8/2017 | Walters | |
| 10,244,824 | B2 | 4/2019 | Hwang et al. | |
| 10,420,396 | B2 | 9/2019 | Hwang et al. | |
| 11,147,343 | B2 * | 10/2021 | Saint Louis | A43B 21/42 |
| 11,297,900 | B2 * | 4/2022 | Yangas | A43B 1/0009 |
| 11,523,659 | B2 * | 12/2022 | Yangas | A43B 21/45 |
| 2019/0029367 | A1 * | 1/2019 | Yangas | A43B 21/30 |

* cited by examiner

HEEL CAP ASSEMBLY

TECHNICAL FIELD

The present invention relates to a heel cap assembly used for replacing a heel cap on high heel shoes. Specifically, the present invention relates to an assembly having a heel cap, an insert, and a rod that connects to a portion of a heel of a high heel shoe.

BACKGROUND

Women's high heels are incredibly sexy and powerful. They allude power and grace. The sound high heel caps make as they hit hard surfaces such as concrete or wooden floors can command attention. The material used to produce heel caps for high heels, for example, but not by way of limitation, hard plastic, hard wood, and/or metal, create the "click" sound often heard when a user wearing such high heels is walking. Unfortunately, since much of a user's weight is carried by the high heels of the shoes, and the heel caps of the high heel shoes therefore receive significant wear and tear, and soon often become extensively damaged. When such high heel shoes are worn extensively on gravel, cement stairs, asphalt roads, and even wooden floors, the heel caps of the high heel shoes begin to wear immediately when they contact hardened surfaces. Once the heel cap begins to wear and disintegrate, the nail embedded in the heel cap to hold the heel cap in a selected position on the high heel ("heel post") of the high heel shoe protrudes from the heel cap, becoming visible and dangerous. The wear on the heel cap and/or the protruding nail often causes an imbalance to the user wearing the damaged shoe with the damaged heel cap, as well as affecting the alignment of the user's body. This occurrence can cause discomfort to the user by creating an unstable high heel in which to walk, and it is also dangerous, because such imbalance and lack of upright alignment may cause a user to slip or to twist an ankle. Additionally, the irregular sound of the nail of such a heel cap hitting a hard surface when a user is walking creates an unpleasant sound. Further, such a nail can result in dents, scratches, and/or marks on wooden floors, stone floors, tile floors, or cement floors, and the like. Moreover, such a nail protruding from a heel cap may also catch on a protrusion or detent in a walkway, causing the user to stumble. The protruding nail/damaged heel cap may also snag unwanted debris/trash from a walkway, resulting in a further danger of causing a user to fall.

As the damaged high heel continues to be worn with the damaged nail protruding, the nail eventually flattens, entrenching itself into the bottom of the heel post causing extensive damage to the remainder of the heel post. This damage may result in an extensive and costly repair and replacement of a new heel cap and a new heel post of the shoe, if it is possible to make such a repair to match the undamaged shoe of the pair of high heel shoes. Often, such a repair and replacement is not possible, resulting in the loss of use of the remaining undamaged shoe, and the requirement of the user to purchase a new pair of high heel shoes.

Several types of preventive heel cap designs have been created to prevent damage to the heel cap. Such products allow users to cover the original heel cap with their design, such as a heel stopper, slip-on caps, and a cap wrap for the bottom of the heel. Each of these choices leave a bulky, awkward appearance of the heel cap and the shoe. The original design of the heel's elegance, grace, and delicacy is distorted. Further, the undamaged heel will also require the different design, further distorting the original appearance and desirability of the pair of high heel shoes.

What is needed is a heel cap assembly which may be used to replace the damaged cap with another heel cap which will be substantially similar or identical to the original heel cap. Such a heel cap assembly would be simple enough for the user of the shoe to replace the damaged heel cap with a new heel cap in an easy manner. Such a heel cap assembly would also permit easy replacement of additional heel caps as needed.

SUMMARY OF THE INVENTION

In one embodiment of the invention, a heel cap assembly for a shoe is provided. The heel cap assembly includes a rod having an upper end, an outer perimeter, and a lower end. The heel cap assembly also includes an insert. The insert has a first end having an opening which forms an inner perimeter, a closed second end, and an outer perimeter having a plurality of protrusions positioned on a surface of the outer perimeter. The heel cap assembly further includes a heel cap having an opening in an upper side and a closed lower side. The opening in the heel cap has an inner perimeter with a frictional surface. At least a portion of the heel cap is formed from a resilient material. The upper end of the rod and at least a portion of the outer perimeter of the rod is configured to be positioned into a hollow tube positioned in a heel post of the shoe. At least a portion of the lower end of the rod extends from the heel post. The lower end of the rod is connected to the inner perimeter of the insert, and the insert is positioned within the opening of the heel cap, such that the heel cap and the insert are frictionally movably connected to permit the heel cap to be moved into a selected position. The resilient material of the heel cap frictionally holds the insert to the heel cap. The frictional resistance between the heel cap and the insert holds the heel cap in the selected position.

In another aspect of the embodiment, an upper end of the rod is inserted into the heel post of the shoe. A lower end of the rod includes a plurality of threads, and the inner perimeter of the insert includes a plurality of threads configured to connect to the plurality of threads of the lower end of the rod.

In a further aspect of the embodiment, the insert includes a plurality of protrusions positioned on the outer perimeter of the insert.

In yet another aspect of the embodiment, the heel cap includes an opening which forms an inner perimeter, and a surface of the inner perimeter includes a frictional surface.

In still a further aspect of the embodiment, when the insert and the heel cap assembly are connected, the plurality of protrusions on the outer perimeter of the insert frictionally connect to the frictional surface of the inner perimeter of the heel cap.

In yet another aspect of the embodiment, the initial frictional connection of the insert and the heel cap permits movement of the heel cap for adjustment into the selected position.

And in a further aspect of the embodiment, when a user wears and places weight on the shoe including the heel cap assembly, the weight of the user causes an expansion of the resilient material creating a stronger and frictional connection which reduces movement between the heel cap and the insert to hold the heel cap in the selected position while the user is walking on the shoe.

In addition, in another aspect of the embodiment, the insert includes a base which provides additional support to a lower end of the insert.

In a further aspect of the embodiment, the plurality of protrusions which extend from the outer perimeter of the insert form a zigzag pattern.

In another aspect of the embodiment, the frictional surface of the inner perimeter of the heel cap is formed from a plurality of striations on the inner perimeter.

In still a further aspect of the embodiment, a hollow tube positionable within the heel of a shoe is also included as a part of the heel cap assembly.

In another embodiment of the invention, a method of using a heel cap assembly with a shoe comprises providing a heel cap assembly which includes 1) a rod having an upper end, an outer perimeter, and a lower end, the lower end having a plurality of threads positioned about the outer perimeter, 2) an insert having an upper end having an opening which has a plurality of threads positioned within a perimeter of the opening. The plurality of threads of the insert are configured to cooperate with the plurality of threads of the rod to provide a connection of the rod and the insert. The insert also has a closed lower end, and an outer perimeter having a plurality of protrusions positioned on an outer surface thereof, and 3) a heel cap which has an opening in an upper side and a closed lower side. The opening has an inner perimeter with a frictional surface. At least a portion of the heel cap is formed from a resilient material. The method also includes inserting the upper end of the rod into a hollow tube positioned in a heel post of the shoe. The method further comprises positioning the outer perimeter of the insert having the plurality of protrusions thereon into the inner perimeter and the frictional surface of the heel cap. In addition, connecting the plurality of threads of the lower end of the rod to the plurality of threads in the inner perimeter of the insert. The method moving the heel cap while the heel cap and the insert are initially frictionally connected together into a selected position.

In one aspect of the other embodiment, when a user wears and places weight on the shoe including the heel cap assembly, the weight of the user causes an expansion of the resilient material of the insert creating a stronger frictional connection between the heel cap and the insert to hold the heel cap in the selected position.

In another aspect of the other embodiment, the insert further includes a base which provides additional support to the closed lower end of the insert.

In a further aspect of the other embodiment, the plurality of protrusions of the insert form a zigzag pattern.

In yet another aspect of the embodiment, the frictional surface of the inner perimeter of the heel cap is formed from a plurality of striations on the inner perimeter.

DETAILED DESCRIPTION OF THE DRAWINGS

The structure, operation, and advantages of the present invention will become further apparent upon consideration of the following description taken in conjunction with the accompanying figures. The figures are intended to be illustrative, and not limiting.

DETAILED DESCRIPTION OF THE PREFERRED EMBODIMENT

In the description that follows, numerous details are outlined to provide a thorough understanding of the present invention. It will be appreciated by those skilled in the art that variations of these specific details are possible while still achieving the results of the present invention.

Exemplary illustrative embodiments of the invention should be interpreted as example(s) and non-limiting. The relationship between various components, where they are located, their composition(s), their operation, and sometimes their sizes relative to the desired operation of the invention are significant.

When introducing elements of various embodiments of the present disclosure, the articles "a," "an," and "the," are intended to mean that there are one or more of the elements. The terms "comprising," "including," and "having" are intended to be inclusive and mean that there may be additional elements other than the listed elements. The variations of "comprising", "including" and "having", such as, but not by way of limitation, "comprise", "include", "have" or "has", are also included in this definition. Any examples of operating parameters and/or environmental conditions are not exclusive of other parameters/conditions of the disclosed embodiments.

As used herein, the term "frictional connection" between two components, such as, for example, but not by way of limitation, the insert and the heel cap, means to seize firmly while still maintaining an initial capability to be moved prior to use by a user. As used herein, the term "initial" means "occurring at the beginning, such as an initial step in a process." As used herein, the term "embed or embedded" means to be non-moveably fixed in a position. For example, but not by way of limitation, a heel cap is moved into an initial selected position, and when a user puts weight into the shoe and particularly the heel cap, the insert is embedded into the heel cap and the heel cap is now in a fixed, non-movably, in the selected position.

Figure 17:
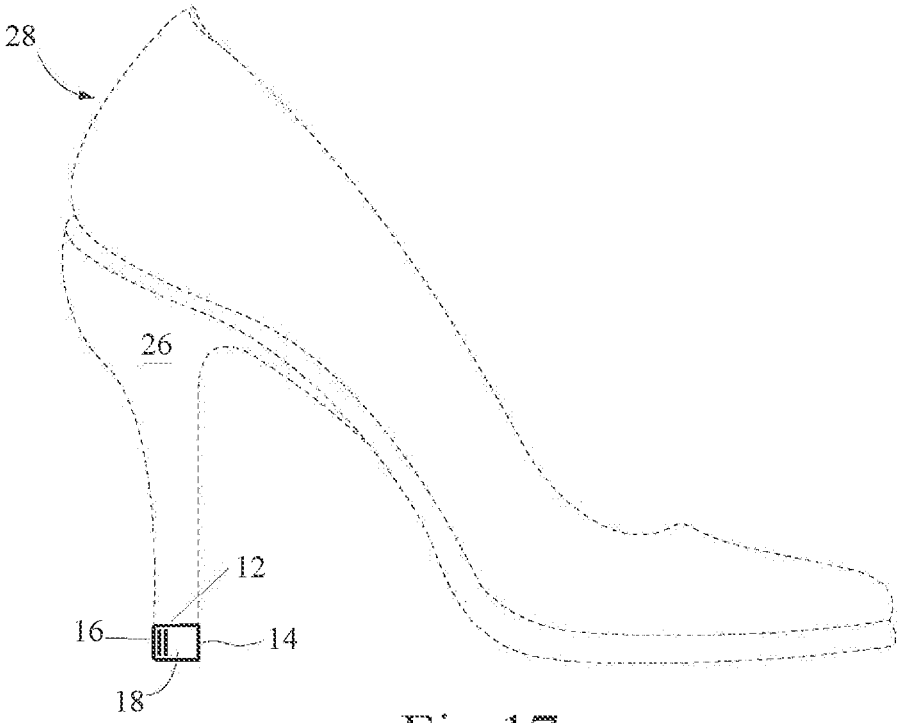
FIG. 17 is a side view of the heel cap of FIG. 16, but showing only the heel cap (the heel post and the shoe shown in phantom lines)
Figure 18:
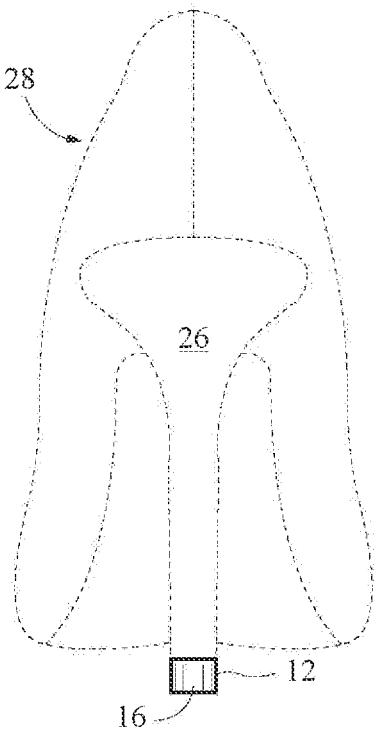
FIG. 18 is a rear side view of the heel cap of FIG. 16, but showing only the heel cap (the heel post and the shoe shown in phantom lines)
Figure 19:
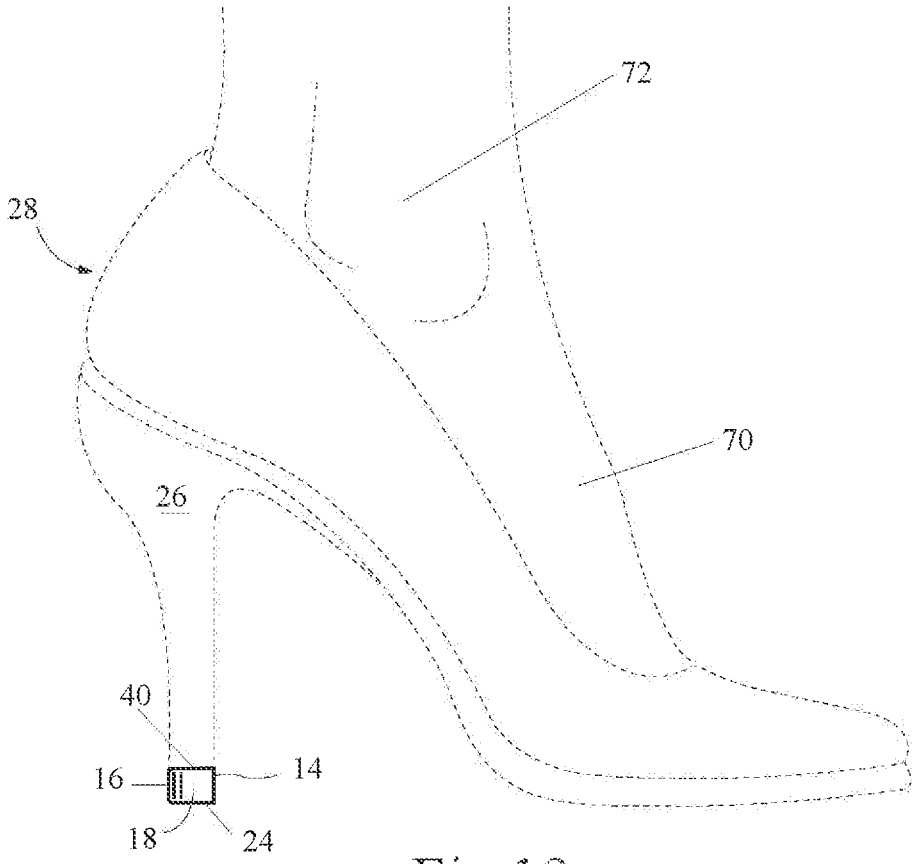
FIG. 19 is a side view of the heel cap of FIG. 16, but showing only the heel cap (the heel post, the shoe, and a user's foot and ankle shown in phantom lines)

As used herein, the word "shoe", as shown and described herein, means a high heel shoe, which may be for example, but not by way of limitation, women's high heel shoe(s) wherein a heel of a user's foot in the shoe is elevated, for example, but not by way of limitation, by one or more inches, relative to a front part of the user's foot in the shoe. Also, the term "shoe" refers to a shoe having a heel cap which is much smaller in size relative to a front part of the shoe, which supports the "ball" of the foot and toes. Examples of this definition are illustrated in FIGS. 17-19.

As used herein, "heel" and/or "heel post", as shown and described herein, means the portion of the shoe which supports a heel of a user's foot. A high heel shoe, as used herein (and as is commonly known), is a shoe which has a heel post which is preferably much higher than the front part of the shoe, permitting the person wearing such a shoe to be taller, i.e., increased in height by the height of the heel post of the shoe. Examples of this definition are illustrated in FIGS. 17-19.

Referring now to FIGS. 1-8, a heel cap assembly 10 is illustrated. The heel cap assembly 10 includes a heel cap 12. The heel cap includes a front side 14, a back side 16, a right side 18, a left side 20, an upper side 22 and a lower side 24. The heel cap 12 illustrated desirable conforms, but not by way of limitation, to the remainder of a heel or heel post 26 of a shoe 28 (FIGS. 15-19). An opening 29 is formed in the upper side 22 of the heel cap 12, however, the opening 29 does not extend to the lower side 24 of the heel cap 12. The heel cap 12 may be formed from at least one of plastic, wood, metal, leather, or any material or combination of materials known and used to form heel caps.

Figure 1:
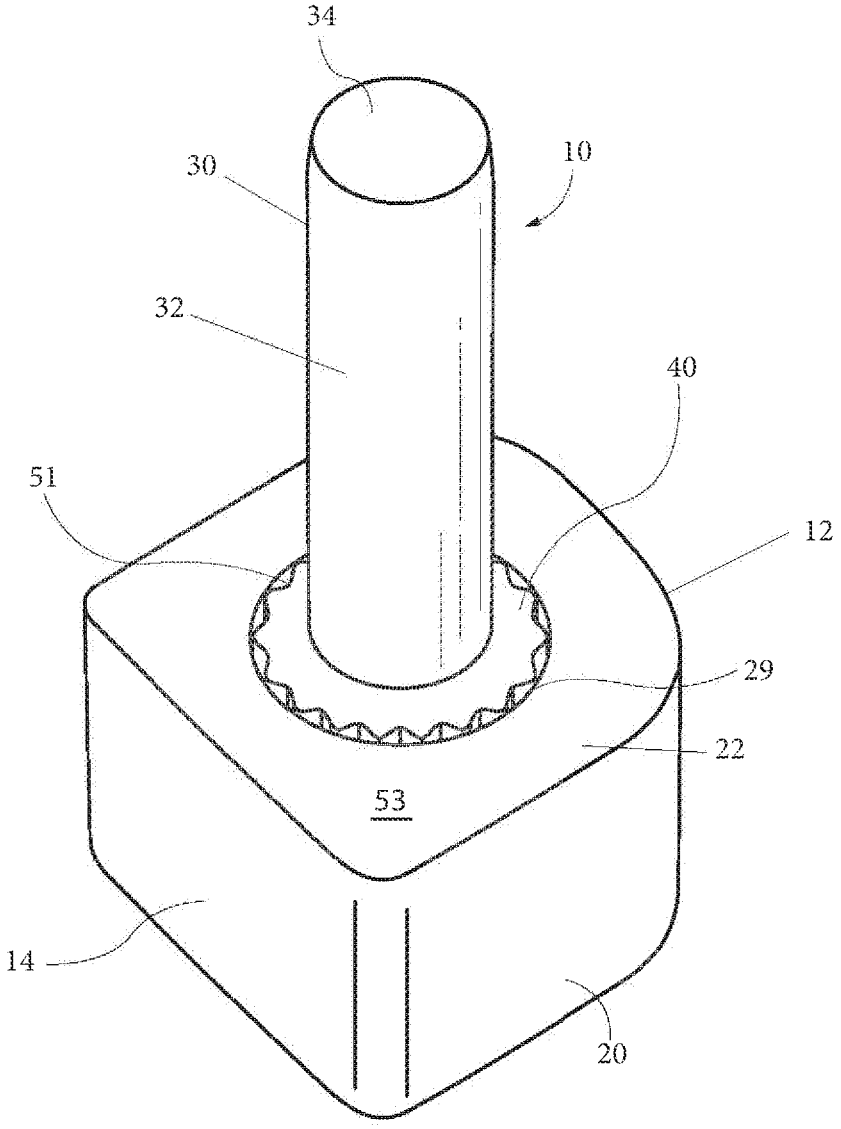
FIG. 1 is perspective view of present invention, showing a heel cap assembly including a rod, an insert, and a heel cap in its assembled position.
Figure 2:
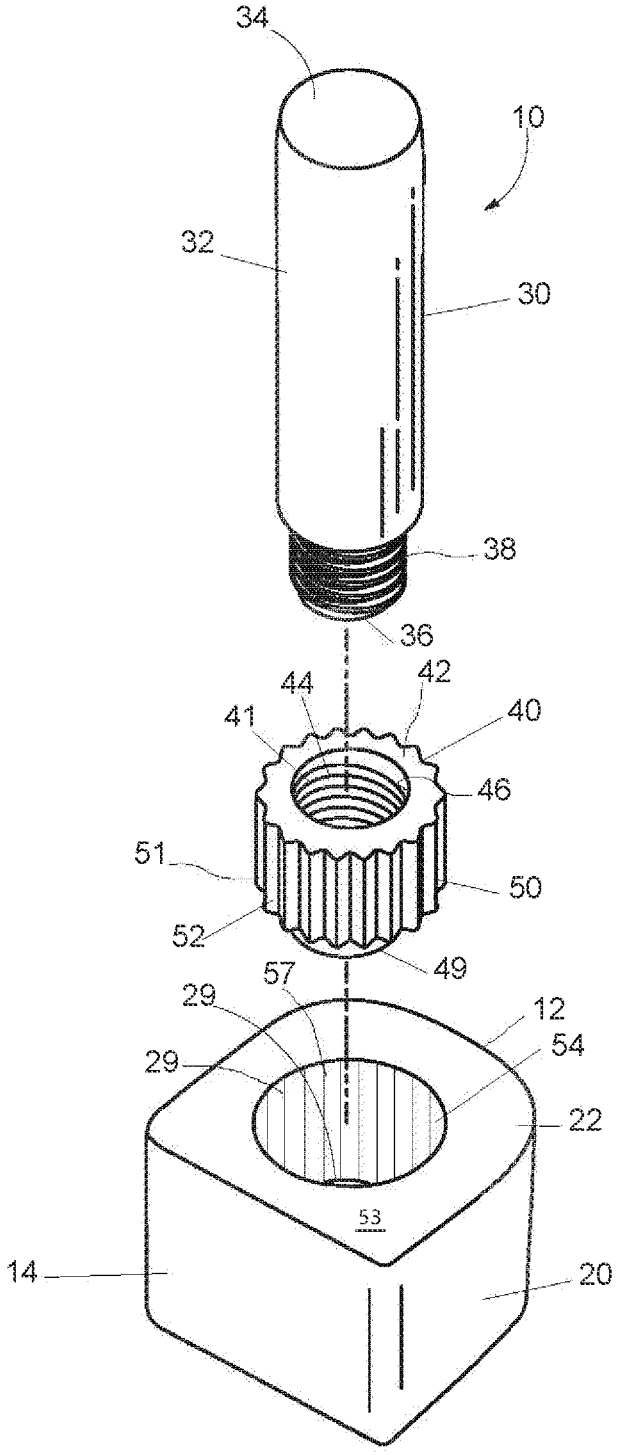
FIG. 2 is an exploded view of FIG. 1, showing the rod, the insert, and the heel cap of the heel cap assembly.
Figure 3:
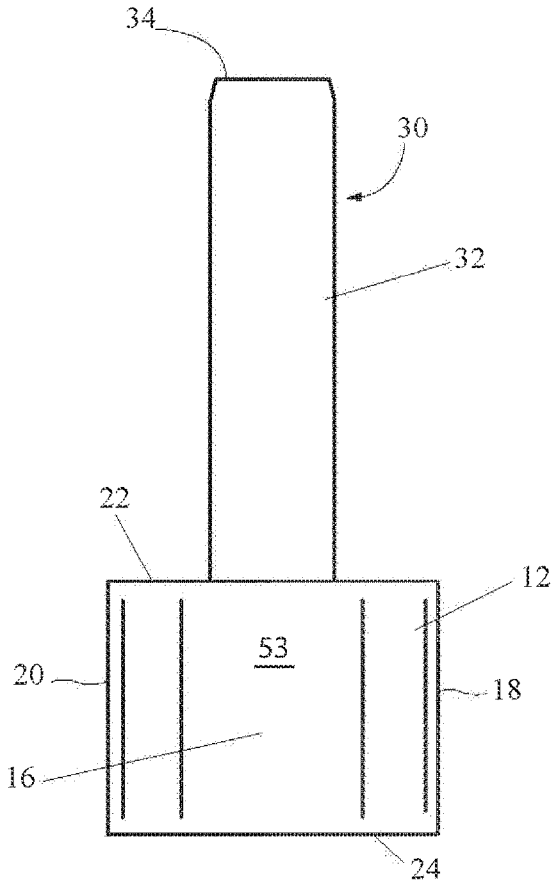
FIG. 3 is a rear view of the heel cap assembly of FIG. 1.
Figure 4:
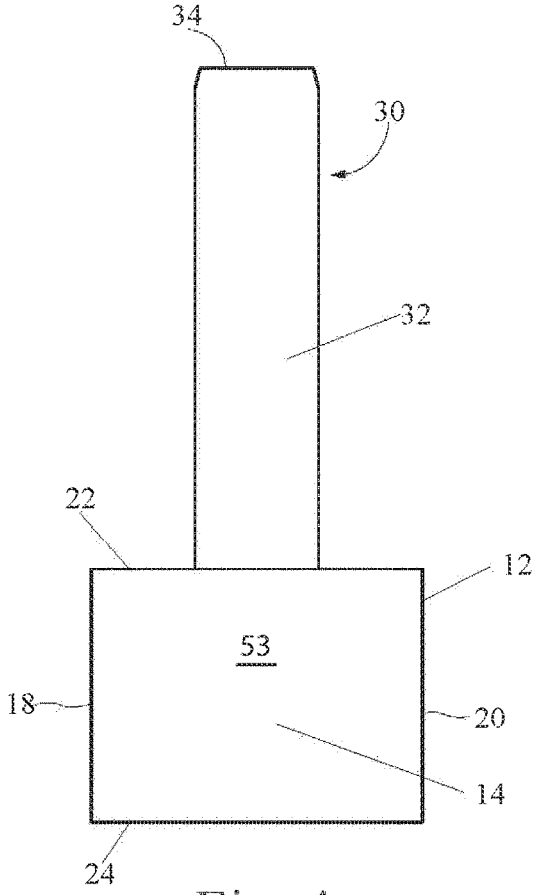
FIG. 4 is a front side view of the heel cap assembly of FIG. 1.
Figure 5:
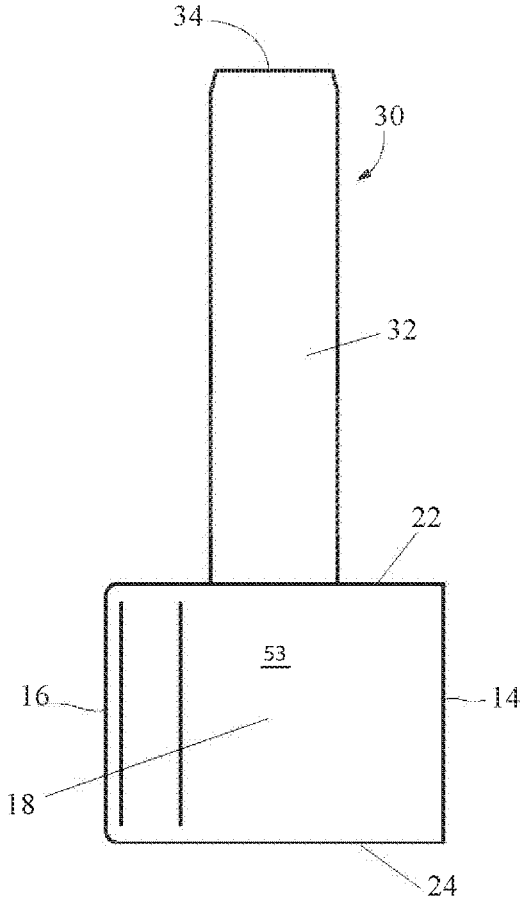
FIG. 5 is a right side view of the heel cap assembly of FIG. 1.
Figure 6:
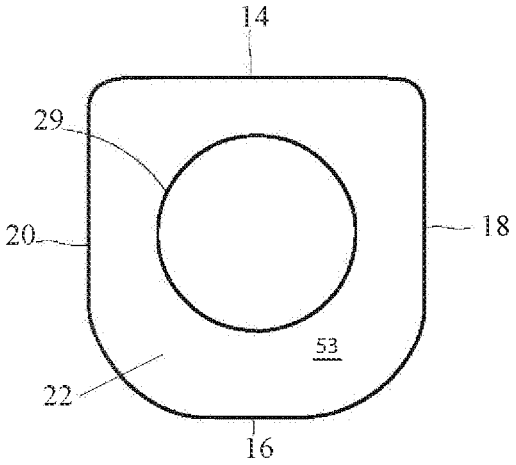
FIG. 6 is an upper side view of the heel cap shown in FIGS. 1 and 2.
Figure 7:
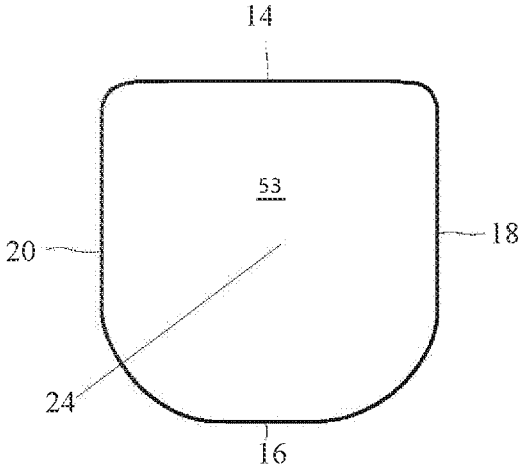
FIG. 7 is a lower side view of the heel cap shown in FIGS. 1 and 2.
Figure 14:
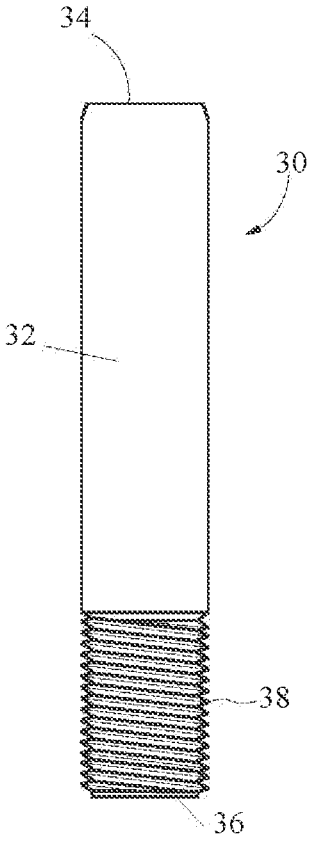
FIG. 14 is a side view of the rod of FIGS. 1 and 2.

The heel cap assembly 10 also includes a rod 30, as shown in FIGS. 1, 2, and 14, which may be, but not by way of limitation, cylindrically-shaped with a rounded outer perimeter 32, as shown in FIG. 2. The rod 30 may be formed from plastic and/or metal. The rod 30 desirably includes an upper end 34 and a lower end 36. As shown in FIG. 2, the lower end 36 includes a plurality of threads 38 formed therearound. The rod 30 may be solid or, alternatively, hollow. The rod 30 may be formed from plastic and/or metal.

Further, the heel cap assembly 10 includes an insert 40, as illustrated in FIGS. 1, 2 and 8-13, which desirably connects the heel cap 12 and the rod 30 together. The insert 40 includes an opening 41 in an upper end 42 of the insert 40. The opening 41 includes an inner perimeter 44, which has a plurality of threads 46 which are formed to cooperatively permit the lower end 36 of the rod 30 to be connected to the insert 40. The insert 40 includes a closed lower end 48 and a base 49 extending therefrom and reinforcing the closed lower end 48. The insert 40 also includes an outer perimeter 50. The outer perimeter 50 desirably has a plurality of protrusions 51 positioned on a surface 52 thereof. In this embodiment, the plurality of protrusions 51 have a zigzag pattern, although it will be recognized that any shape and/or pattern that operates as shown and described herein may be used. The term "zigzag" as used herein, means a line, course, or progression characterized by sharp turns first to one side and then to the other. Desirably, the insert 40 is formed from a metal.

Figure 8:
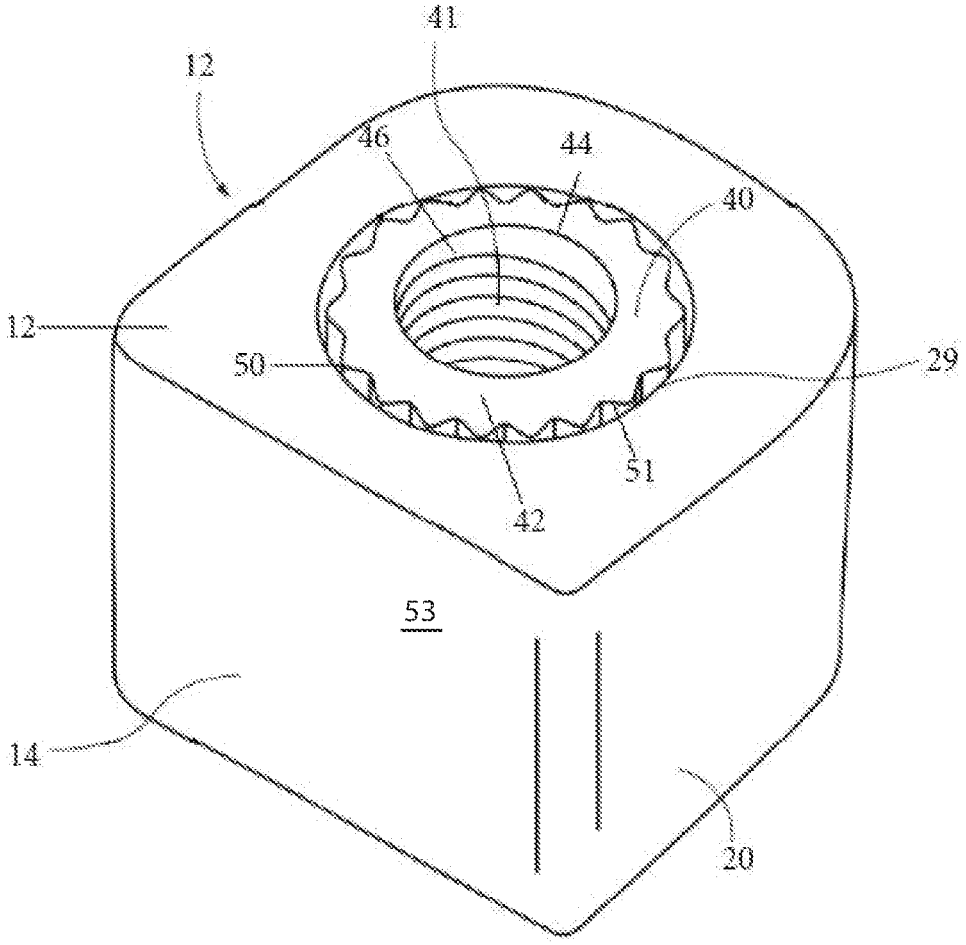
FIG. 8 is a perspective view of the heel cap and the insert of FIGS. 1 and 2, but showing the heel top and insert connected.
Figure 9A:
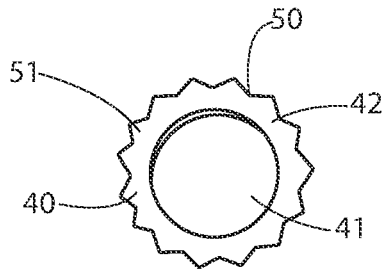
FIG. 9A is a top plan view of the upper end of the insert shown in FIGS. 1 and 2.
Figure 10:
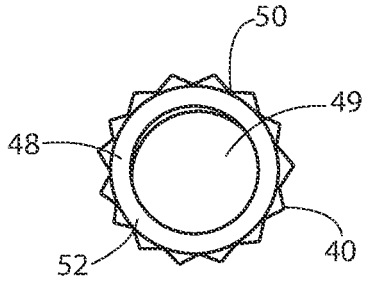
FIG. 10 is a bottom plan view of the lower end of the insert shown in FIGS. 1 and 2.
Figure 9B:
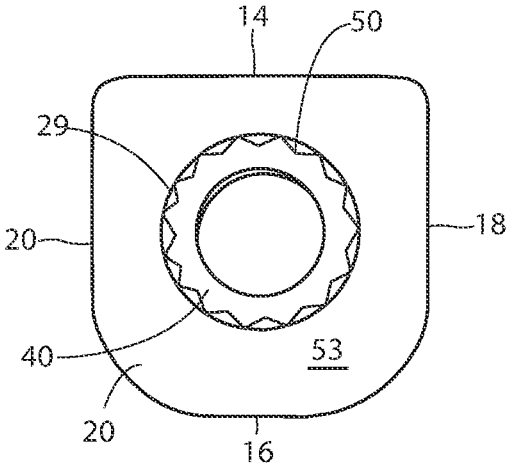
FIG. 9B is a top plan view of FIG. 8, but showing the plurality of protrusions connected to the inner perimeter of the opening in the heel cap.
Figure 11:
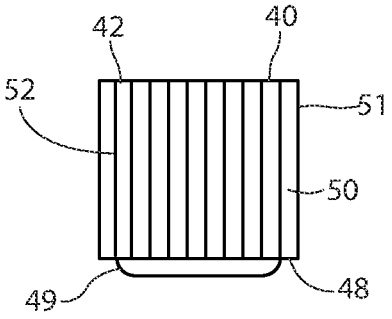
FIG. 11 is a side view of the insert shown in FIGS. 1 and 2.
Figure 12:
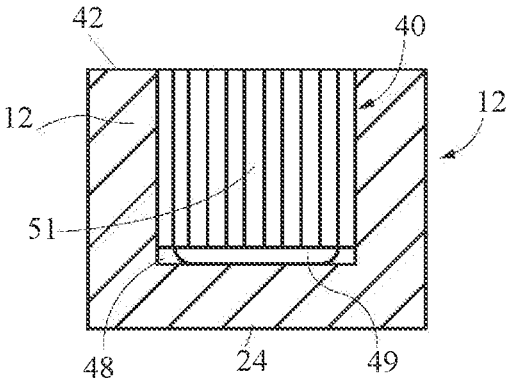
FIG. 12 is a sectional view of the heel cap and a side view of the insert of FIGS. 1 and 2, showing the insert when positioned within the heel cap.

The heel cap 12 may be formed at least partially from at least one of plastic, rubber, wood, metal, leather, or any material or combination of materials known and used to form heel caps. However, desirably, at least the portion of the heel cap 12 that is contacted by the insert 40 is formed from a strong and flexible resilient plastic material 53. The term "resilient material, as used herein, means a material which returns to its original form or position after being bent, compressed, and/or stretched. Such a resilient material is desirably used to form at least a portion, or alternatively, all of the heel cap 12. FIG. 8 and especially FIG. 9B illustrates the resilient material 53 of the heel cap 12 when contacted by the insert 40. Such resilient material is known and commercially available. Besides the inclusion of resilient material 53.

As also illustrated in FIGS. 1, 2, 8-13, the opening 29 in the heel cap 12 includes the generally circumferentially shaped inner perimeter 54. "Generally, circumferentially-shaped," as used herein for the inner perimeter 54 of the insert 40, means having a circumferential inner perimeter 54. The inner perimeter 54 desirably has a frictional and roughened and/or irregular surface, such as, for example, but not by way of limitation, a plurality of striations 56 carried on a surface 57 of the inner perimeter 54, as shown in FIG. 2. As used herein, "Frictional and roughened or irregular" means a surface having a coarse, and uneven surface, as from projections, irregularities, or breaks therein. It will be understood that other frictional and roughened surfaces, or use of any other shapes or forms to provide such a frictional and roughened surface, may also be used within the inner perimeter 54. As illustrated in FIG. 1, the insert 40 is sized to be received and held within the opening 29 of the heel cap 12.

Figure 13:
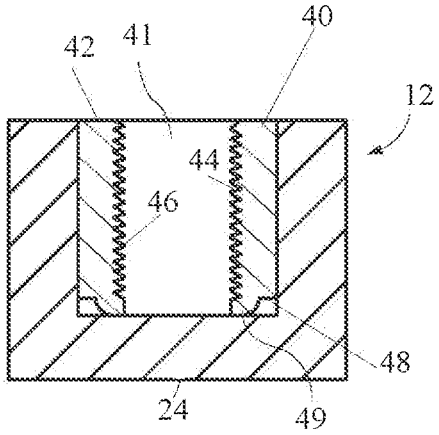
FIG. 13 is a sectional view of the heel cap and the insert of FIGS. 1 and 8, showing the insert and the heel cap when positioned in a connected position, the plurality of protrusions of the insert frictionally connected to the inner perimeter of the opening in the heel cap.

Significantly, however, it will also be observed in FIGS. 1, 8 and 13 that the plurality of protrusions 51 of the outer perimeter 50 of the insert 40 frictionally contact the plurality of striations 56 of the surface 57 of the inner perimeter 54 of the heel cap 12. In fact, it is desirable that the plurality of protrusions 51 of the insert 40 and the plurality of striations 56 of the heel cap 12 frictionally contact each other and frictionally yet initially movably connect the insert 40 and the heel cap 12 together. Such a frictional yet initially moveable connection is useful in aligning a replacement heel cap 12 and insert 40 combination with the heel post 26 of the shoe 28. It will be appreciated that the weight of the user or wearer assists in maintaining a continued frictional connection between the insert 40 and the heel cap 12 via the resilient material 53 of the insert 12, so that after the initial movement to align the heel cap 12 with the heel post 26 of the shoe 28, the resilient material 53 of the heel cap 12 is "grasped" via each protrusion of the plurality of protrusions 51 of the insert 40 to hold the heel cap 12 in the desired alignment. 40.

Figure 15:
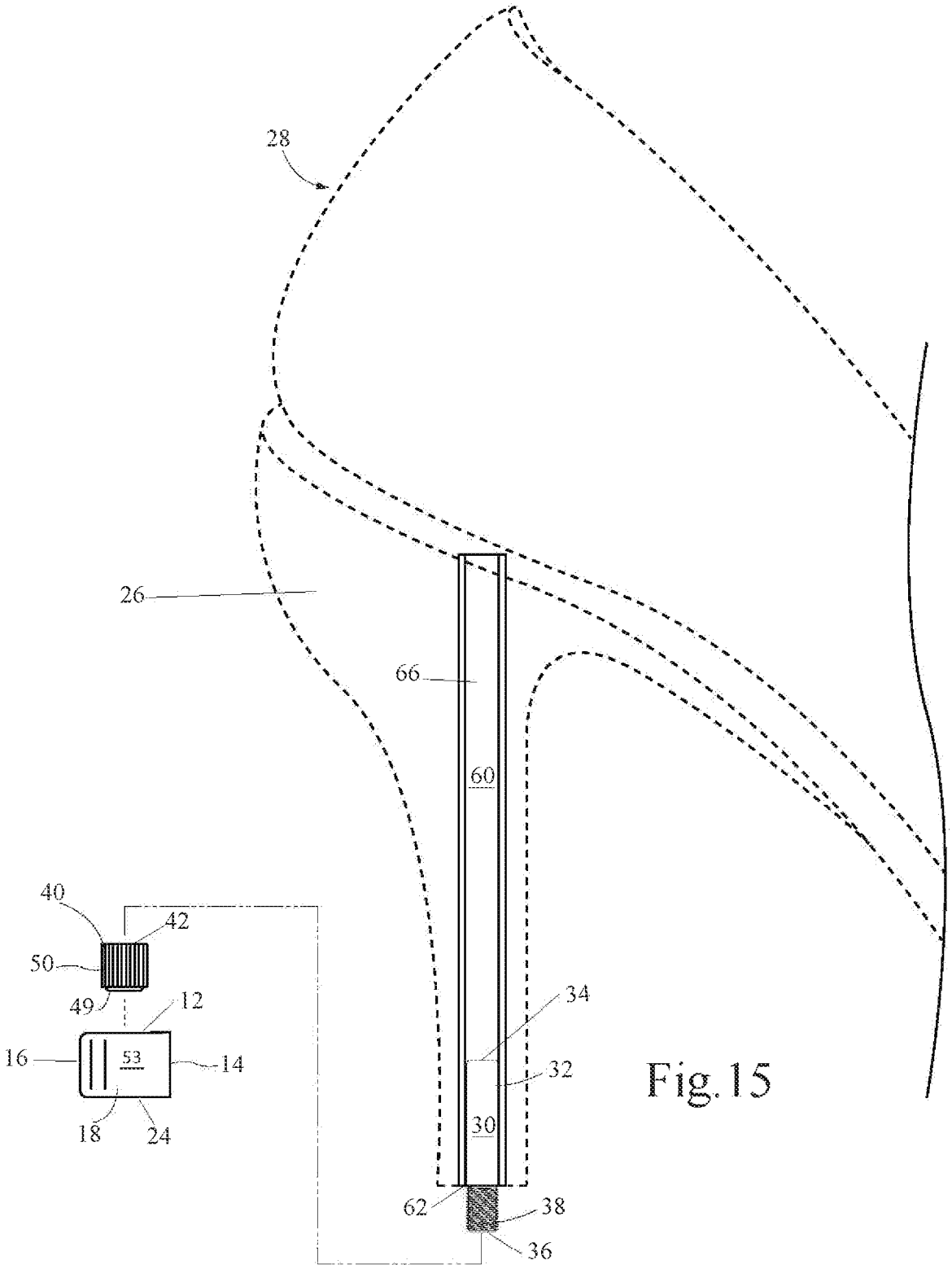
FIG. 15 is a exploded side view of the heel cap assembly of FIGS. 1 and 2, showing a portion of the rod inserted into a hollow tube positioned in a heel post of a shoe (the heel post and shoe illustrated by phantom lines), and showing the insert and heel cap positioned to be connected to the rod.
Figure 16:
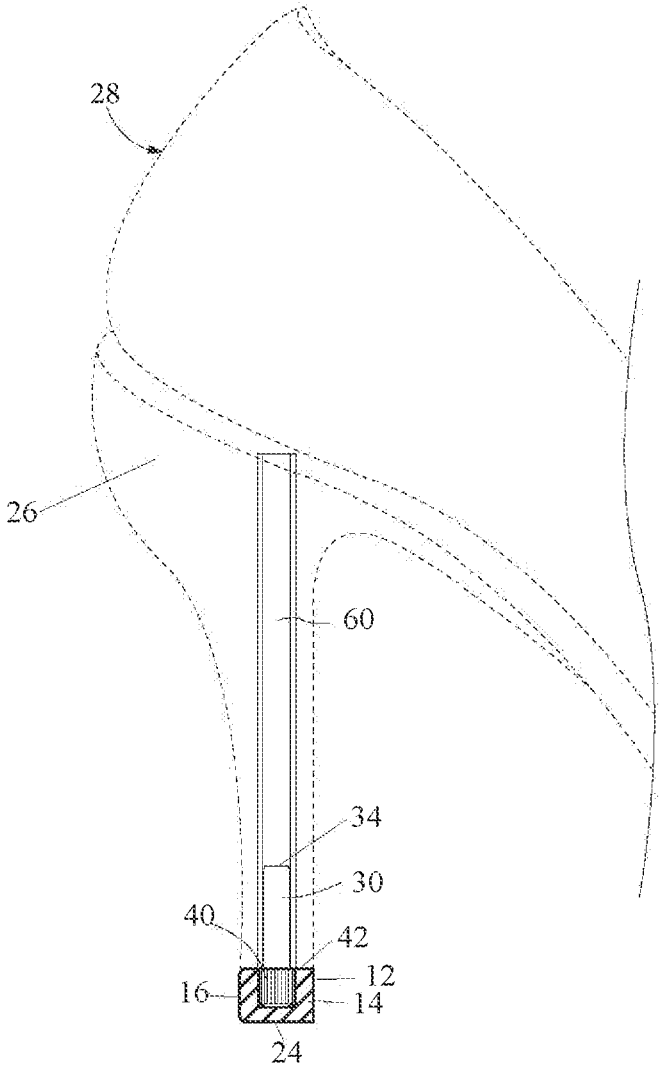
FIG. 16 is a side view similar to FIG. 15, but showing the completed assembly of the heel cap assembly when connected to the heel post of the shoe (the heel post and the shoe shown in phantom lines)

FIGS. 15 and 16 illustrate the placement of the heel cap assembly 10 within the heel post 26 of the shoe 28. Shoe 28 may have a bore (namely, for example, a cylindrical opening (not shown)) formed medially within the heel post 26 and extending vertically therein. A metal and/or plastic hollow tube 60 is desirably carried in the bore to provide further strength to the heel post 26 as well as to hold a nail or screw assembly commonly used when manufacturing a shoe 28 with a heel post 26 to connect the original heel cap 12 to a lower end 62 of the heel post 26 (not shown). It will be appreciated that the used nail or screw assembly along with the used/damaged heel cap is first removed (not shown). The outer perimeter 32 of the rod 30 is desirably sized to frictionally fit within an opening of the hollow tube 60 thereof. The upper end 34 of the rod 30 is inserted into the hollow tube 60 to form a frictional connection therewith. It will be understood that a frictional and roughened surface, and the like, may be provided at least on the outer perimeter 32 of the rod 30 to assist in forming the frictional connection. Desirably, the lower end 36 of the rod 30 with the plurality of threads 38 thereon extends away from the lower end 62 of the heel post 26. It will be appreciated that in an alternative heel cap assembly 10, the hollow tube 60 may also form a component of the heel cap assembly 10.

The insert 40 having a plurality of threads 48 on the inner perimeter 46 thereof is desirably connected to the plurality of threads 38 on the outer perimeter 32 of the lower end 36 of the rod 30. Then, the insert 40 and the heel cap 12 are desirably frictionally connected together when the insert 40 is positioned into the opening 29 of the heel cap 12, as illustrated in FIG. 16.

The insert 40 is frictionally positioned into the opening 29 in the heel cap 12, and the heel cap 12 is frictionally, but still movably, connected to the insert 40, which permits the heel cap 12 to be moved sufficiently to be aligned into the desired or selected position. Due to the resilient material 53 forming at least a portion of the heel cap 12 and providing at least a portion of the frictional yet slightly movable connection with the heel cap 12, when pressure is applied to the heel cap/insert 40 combination after the heel cap 12 is aligned in the selected position, the weight of a user's foot 70 within the shoe 28 as shown in FIG. 19 causes the resilient material 53 to expand and causes the insert 40 to embed via the plurality of protrusions 51 thereof into the inner perimeter 54 of the heel cap 12, therefore permanently fixing and connecting the heel cap 12/insert 40 combination together in the selected position, as shown in FIGS. 8, 9B, and 13.

When the heel cap 12 becomes worn, the insert 40 may start showing through at least a portion of the heel cap 12. Also, the insert 40, when contacting a surface, may make a different sound than the heel cap 12 when a user is walking on the shoe 28, due to the metal used to form the insert 40, which may result in a "click" noise every time the heel cap 12 (and therefore the insert 40) contacts a floor surface. Either sight, sound, or both alerts the user that the worn heel cap 12/insert 40 combination should be removed. The new heel cap 12/insert combination is easily replaced and connected as shown and described herein to the insert 40.

Figure 20:
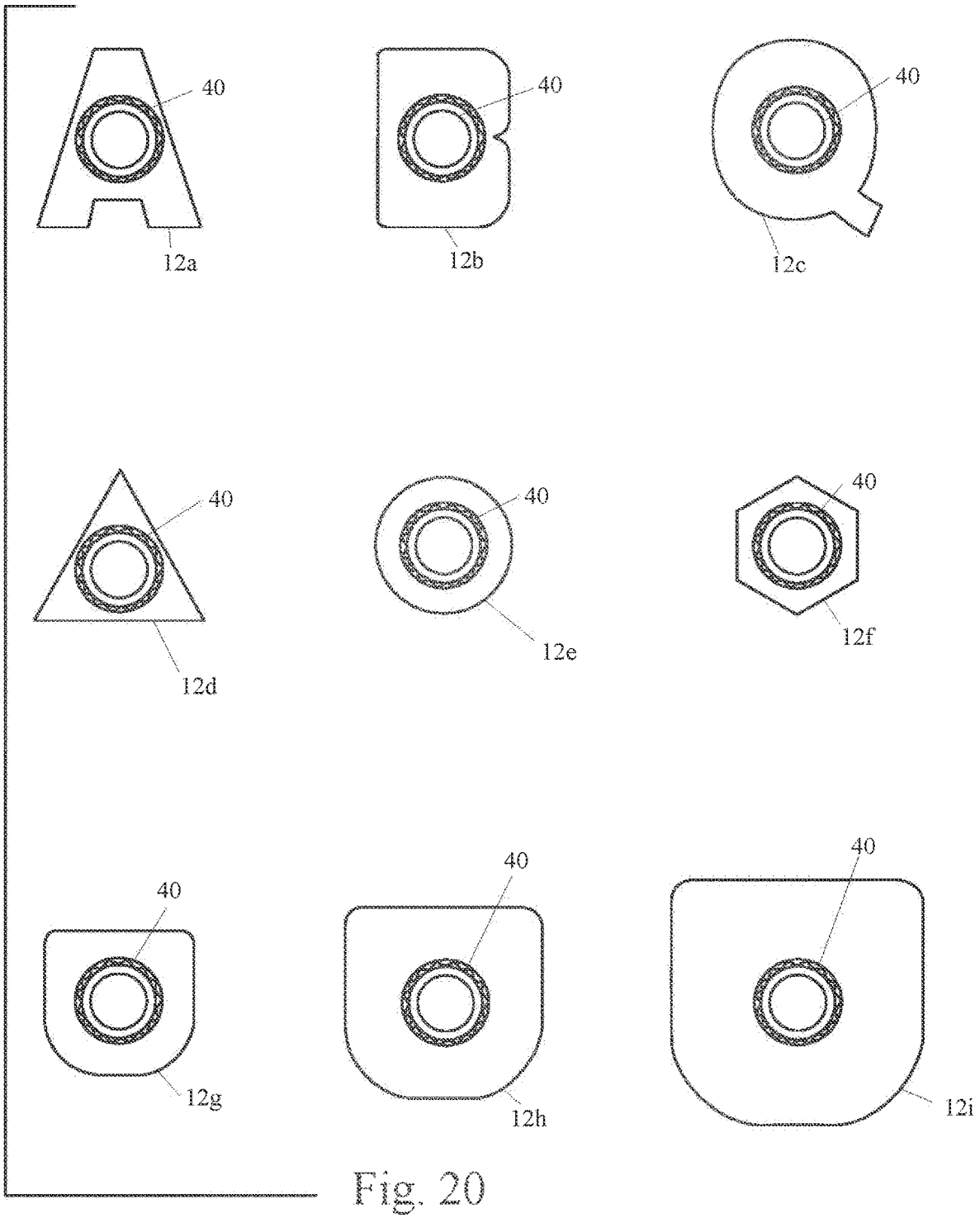
FIG. 20 is a top plan view similar to FIGS. 1, 2, and 8, but showing a non-limiting variety of different styles of heel caps having the insert connected thereto.

FIGS. 16-18 illustrate right and left side views of the shoe 28 carrying the heel cap assembly 10. FIG. 19 shows a side view of the heel cap assembly as illustrated in FIGS. 16-18 but showing the user's foot 70 held within the shoe 28, as well as the user's ankle 72. FIG. 20 provides examples, but not by way of limitation, of some of the many different types/styles of heel caps 12*a*-12*i* which may be used in the heel cap assembly 10.

In a method of use, a user would take the components of FIGS. 1 and 2, and install the upper end of the rod 30 into the lower end 62 of the hollow tube 60, leaving only the lower end 36 of the rod 30 extending from the hollow tube 60. The insert 40 is then inserted into the heel cap 12. Then, the lower end 36 of the rod 30 and the plurality of threads 38 thereon are connected to the insert 40 via the plurality of threads 46 on the inner perimeter 44 of the insert 40. The heel cap 12 is then frictionally moved, relative to the frictionally connected insert 40, as needed, for a final adjustment into the selected position in alignment with the heel post 12 and the shoe 28. Alternatively, each component may be connected to the other separately. The weight of the user wearing and walking in the shoe 28 assists to maintain the heel cap 12 in the desired position by way of the expansion of the resilient material 53 of the heel cap 12 against the plurality of protrusions 51 of the insert 40 (as shown in FIGS. 8 and 15), therefore creating an even greater frictional connection between the insert 40 and the heel cap 12.

It will be appreciated that at least the heel cap assembly 10 may be provided in a kit, so that a user may repair a valuable pair of shoes. Alternatively, the kit may be used by a shoe repair service as well.

Although the invention has been shown and described concerning a certain preferred embodiment or embodiments, certain equivalent alterations and modifications will occur to others skilled in the art upon the reading and understanding of this specification and the annexed drawings. In particular regard to the various functions performed by the above-described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a feature of the invention may have been disclosed concerning only one of several embodiments, such feature may be combined with one or more features of the other embodiments as may be desired and advantageous for any given or particular application.

What is claimed is:

1. A heel cap assembly for a shoe including a heel, the heel cap assembly comprising:

a rod having an upper end, an outer perimeter, and a lower end;

an insert having an upper end having an opening therein which forms an inner perimeter, a closed lower end and an outer perimeter having a plurality of protrusions positioned on a surface thereof; and a heel cap having an opening in an upper side and a closed lower side, the opening having an inner perimeter with a frictional surface formed thereon, at least a portion of the heel cap which contacts the insert formed from a resilient material, the heel cap adapted to include a conformation identical to the conformation of a lower end of the heel of the shoe;

wherein the upper end of the rod and at least a portion of the outer perimeter of the rod is configured to be positioned into a hollow tube positioned in a heel post of the shoe, such that at least a portion of the lower end of the rod extends therefrom, wherein the lower end of the rod is connected to the inner perimeter of the insert when the insert is positioned within the heel cap, such that the heel cap and the insert are initially frictionally but movably connected to permit the heel cap to be moved into a selected position which conforms to and aligns with the conformation of the lower end of the heel of the shoe, and wherein at least the portion of the resilient material of the heel cap frictionally holds the insert to the heel cap, and wherein the heel cap is secured and embedded permanently in the selected position only when the weight of a user is applied to the heel post of the shoe.

2. The heel cap assembly of claim 1, wherein an upper end of the rod is inserted into the heel post of the shoe, and the lower end of the rod includes a plurality of threads, and the inner perimeter of the insert includes a plurality of threads configured to connect to the plurality of threads of the lower end of the rod.

3. The heel cap assembly of claim 1, wherein the plurality of protrusions positioned on the surface of the outer perimeter of the insert form a frictional surface and wherein the heel cap includes an opening having an inner perimeter, and the surface of the inner perimeter includes a frictional surface, and wherein neither the frictional surface of the insert nor the frictional surface of the heel cap forms an identical interlocking frictional surface relative to each other.

4. The heel cap assembly of claim 3, wherein when the insert and the heel cap assembly are connected, the plurality of protrusions on the outer perimeter of the insert frictionally connect to the frictional surface of the inner perimeter of the heel cap to form an initially movable the frictional connection to permit movement of the heel cap for adjustment into the selected position.

5. The heel cap assembly of claim 4, wherein when a user places weight on the shoe including the heel cap assembly, the weight of the user causes an expansion of the resilient material of the heel cap which then forms a permanent embedded connection between the heel cap and the insert to permanently prevent movement therebetween.

6. The heel cap assembly of claim 3, wherein the plurality of protrusions which extend from the outer perimeter of the insert form a zigzag pattern.

7. The heel cap assembly of claim 6, wherein the frictional surface of the inner perimeter of the heel cap is formed from a plurality of striations on the inner perimeter thereof.

8. The heel cap assembly of claim 1, wherein the insert includes a base which provides additional support to the closed lower end of the insert.

9. The heel cap assembly of claim 1, wherein the hollow tube positioned within the heel post of the shoe is also included as a component of the heel cap assembly.

10. The heel cap assembly of claim 1, wherein the conformation of the heel of the shoe is an asymmetrical conformation at least between the front of the heel and the rear of the heel, and wherein the confirmation of the heel cap includes the asymmetrical conformation of the heel.

11. The heel cap assembly of claim 10, wherein the selected position of the heel cap conforms to and aligns with the conformation of the heel.

12. A method of using a heel cap assembly to repair a shoe including a heel, the method comprising:

providing a heel cap assembly comprising a rod having an upper end, an outer perimeter, and a lower end, the lower end having a plurality of threads positioned about the outer perimeter thereof;

an insert, the insert having an upper end having an opening which forms an inner perimeter therein, a plurality of threads positioned therein, the plurality of threads configured to cooperate with the plurality of threads of the rod to provide a connection therebetween, the insert also including a closed lower end, and an outer perimeter having a plurality of protrusions positioned on a surface thereof; and a heel cap having an opening in an upper side and a closed lower side, the opening forming an inner perimeter having a frictional surface, at least a portion of the insert formed from a resilient material, the heel cap formed to include a conformation identical to the conformation of a lower end of the heel of the shoe;

inserting the upper end of the rod into a hollow tube positioned in a heel post of the shoe;

positioning the outer perimeter of the insert and the plurality of protrusions thereon into the opening defined by an inner perimeter and frictional surface of the heel cap;

connecting the plurality of threads of the lower end of the rod to the plurality of threads on the inner perimeter of the insert;

moving the heel cap while the heel cap and the insert are initially frictionally connected together into a selected position; which conforms to and aligns with the conformation of the lower end of the heel of the shoe; and permanently securing and embedding the heel cap into the selected position only when the weight of a user is positioned into the heel cap of the shoe, resulting in a fixed, non-movable position of the heel cap relative to the shoe.

13. The method of claim 12, wherein in the step of moving the heel cap, when the user places weight on the shoe including the heel cap assembly, the weight of the user causes an expansion of the resilient material of the heel cap which creates a stronger connection between the heel cap and the insert which permanently embeds the heel cap in the selected position.

14. The method of claim 12, wherein in the step of providing a heel cap assembly, the insert further includes a base which provides additional support to the closed lower end of the insert.

15. The method of claim 12, wherein in the step of providing a heel cap assembly, the plurality of protrusions on the outer perimeter of the insert forms a zigzag pattern, and the inner perimeter of opening in the heel cap is formed to include a plurality of striations, such that neither the zig zag pattern of outer perimeter of the insert nor the plurality of striations forming the inner perimeter of the heel cap forms an identical interlocking frictional surface relative to each other.

16. The method of claim 12, wherein the conformation of the heel of the shoe is a symmetrical conformation between the front of the heel and the rear of the heel, and wherein the confirmation of the heel cap includes the symmetrical conformation of the heel.

17. The method of claim 16, wherein the selected position of the heel cap conforms to and aligns with the conformation of the heel.

* * * * *